US005252426A

United States Patent [19]

Chan

[11] Patent Number: 5,252,426

[45] Date of Patent: Oct. 12, 1993

[54] MONO-AND DIFLUOROACETYLPHENYL HYDRAZINE COMPOUNDS AS SILVER HALIDE ADJUVANTS

[75] Inventor: Dominic M. Chan, Wilmington, Del.

[73] Assignee: E. I. du Pont de Nemours and Company, Wilmington, Del.

[21] Appl. No.: 737,150

[22] Filed: Jul. 29, 1991

[51] Int. Cl.[5] ..... G03C 1/06

[52] U.S. Cl. ..... 430/264; 430/598; 430/963

[58] Field of Search ..... 430/264, 598, 963

[56] References Cited

U.S. PATENT DOCUMENTS

| | | | |
|---|---|---|---|
| 4,030,925 | 6/1977 | Leone et al. . | |
| 4,221,857 | 9/1980 | Okutsu et al. . | |
| 4,278,748 | 7/1981 | Sidhu et al. . | |
| 4,686,167 | 8/1987 | Resnick et al. . | |
| 4,937,160 | 6/1990 | Ruger . | |
| 4,988,603 | 1/1991 | Takamuki et al. | 430/264 |
| 5,037,719 | 8/1991 | Nakamura | 430/264 |
| 5,100,761 | 3/1992 | Yagihara et al. | 430/264 |

FOREIGN PATENT DOCUMENTS

| | | | |
|---|---|---|---|
| 0368229 | 5/1990 | European Pat. Off. | 430/264 |

OTHER PUBLICATIONS

H1063, Jun. 1992, Hosoi, Y., "Negative Type Light Sensitive Silver Halide Photographic Material, U.S. Statutory Invention Registration".

Journal of Photographic Science, vol. 35, No. 5, Sep. 1987, London GB pp. 162–164.

*Primary Examiner*—Charles L. Bowers, Jr.

*Assistant Examiner*—Thomas R. Neville

[57] ABSTRACT

A novel group of fluoroacetylphenyl hydrazines useful in insuring rapid-access processing of lithographic film elements is described. These hydrazines not only will produce good dot quality under conditions of rapid-access processing, but can be used a lower pH than conventional, prior art elements and will produce lower fog.

5 Claims, No Drawings

MONO-AND DIFLUOROACETYLPHENYL HYDRAZINE COMPOUNDS AS SILVER HALIDE ADJUVANTS

BACKGROUND OF THE INVENTION

1. Field of the Invention

This invention relates to silver halide elements and more specifically to silver halide elements used to prepare half-tone images therefrom. Still more specifically, this invention relates to a novel group of hydrazines that can be advantageously added to said silver halide elements to improve the contrast and dot quality of images produces thereon.

2. Discussion of the Prior Art

Prior art silver halide elements used for half-tone work in the graphic arts industry, for example, usually employ standard silver halide elements that are processed in high pH developers that use hydroquinone or substituted hydroquinone as the main developing agent. These elements produce high quality images with excellent half-tone dots and high contrast. However, these processes are relatively slow and usually require an induction period before the so-called "lith" effect occurs.

Recently, there has been a pressing need in the industry to decrease the processing time required to product the lith images. Commercially, large users of lith products have demanded that the industry produce rapid-access products similar to that of the medical X-ray industry, for example. A number of prior art references describe the addition of various hydrazines to the emulsions or to the developers to obtain this rapid-access quality. Most of these references employ phenylformylhydrazine, or derivatives thereof, in order to achieve the requisite processability. However, the images obtained with these compounds is not as good as that which is achieved by normal lith products and the pH of the developers employed is still rather high.

Ruger, U.S. Pat. No. 4,937,160, Jun. 26, 1990, describes a system which uses a novel group of aryl hydrazides to achieve the rapid access processability at a lower pH. Good images and contrast are produced by the Ruger process. However, there is an ever increasing need to improve the images and dot quality even further.

It is an object of this invention to provide a silver halide element which can be processed under the conditions of rapid access and still produce a high contrast, high quality image with excellent dot quality. It is also an object of this invention to produce a silver halide element that can be processed at a lower pH than conventional, prior art elements, and yet produce an image with lower fog.

SUMMARY OF THE INVENTION

These and yet other objects are achieved in a gelatino silver halide element capable of producing images with ultra-high contrast, wherein said element contains a hydrazine of the following structure I:

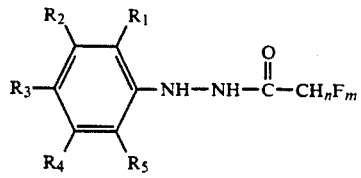

wherein $R_1$ to $R_5$ independently of the other are hydrogen, halogen, alkyl, alkoxy, hydroxyalkyl, halogenated alkyl, alkyl amino, aliphatic acylamino, with, in each case, 1 to 20 carbon atoms, cycloalkyl with 5 to 7 carbon atoms, aryl, aryloxy, or aromotic acylamino with, in each case, 6 to 10 carbon atoms, aralkyl or aralkoxy with 1 to 3 carbon atoms in the alkylene chain, an aliphatic acyl amino radical with 1 to 4 carbon atoms and substituted with a phenoxy radical or a phenoxy radical substituted with one or more alkyl radicals with 1 to 10 carbon atoms, a five-member or six-member heterocyclic ring with at least one of nitrogen and sulfur as heteroatoms, which ring can also be condensed on a benzene ring, or an alkyl or phenyl sulfonamido radical, whereby, in place of two substituents, a saturated or unsaturated ring can also be condensed onto the hydrazine, n and m are 1 or 2, and where $n+m=3$.

A preferred hydrazine is of the formula II:

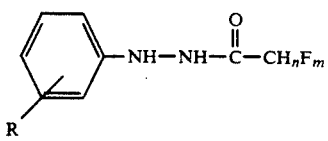

II wherein R is H, a phenyl group or a substituted phenyl group, an alkyl, alkoxy or a cycloalkoxy with up to 6 carbon atoms or halogen, n and m are 1 or 2, and where $n+m=3$. In yet a further embodiment, the compounds described herein may advantageously be added to the fluids used to process these silver halide elements and equivalent sensitometric results may also be achieved.

DETAILED DESCRIPTION OF THE INVENTION

Silver halide elements useful within the metes and bounds of this invention may include any of the conventional halides such as silver bromide, silver chloride, silver iodide or mixtures of two or more halides, for example. The silver halides may be manufactured using any of the conventional and well-known techniques, such as by splash or balanced-double-jet precipitation methods. The grains produced by these methods include spherical, tabular, rhombic and other conventional silver halide grain shapes. Conventionally, the grains are precipitated in a small amount of photographic quality gelatin. After ripening to produce the desired qualities, the grains are gathered by coagulation and washing or by some other sort of process which will remove the unreacted materials and unused halide salts. The grains are then conventionally dispersed in a larger amount of gelatin and they may be sensitized by any of the well-known techniques, e.g., gold and sulfur; metal sensitization, etc. Spectral sensitizing dyes are often added to improve the spectral response of any product prepared therefrom. Additionally, antifoggants, wetting agents, coating aides, hardeners all may be advantageously added to these emulsions for the desired purpose. The emulsions can then be coated on any of the conventional and well-known photographic supports such as dimensionally stable polyethylene terephthalate (known as "polyester") as well as other transparent or semi-transparent materials may be mentioned among many others. The emulsion layer may also be overcoated with a thin layer of hardened gelatin to protect the relatively soft emulsion during subsequent handling, for example. Backing and antihalation layers may also be included in this element.

Silver halide elements prepared using the compounds of this invention may be exposed and processed in conventional processing fluids. Processing fluids normally used with lith systems are mainly based on dihydroxy benzenes, e.g, hydroquinone, and are generally considered to be slow systems. Processing fluids used in contact with elements are prepared according to the teachings of this invention may also contain super-additive developing agents such as 1-phenylpyrazolidone or N-methyl-p-aminophenol and the like These developing ingredients increase the speed at which films can be developed (so-called "rapid access" systems). However, as is well-known, these rapid-access developing systems are not conventionally used with standard lith elements because of the effect these systems have on the image quality. Of course, as previously mentioned, prior art hydrazine and hydrazide containing elements can indeed be used with these rapid-access systems and the image quality will be improved However, with the mono- and di- fluoroacetylhydrazine compounds of this invention, image quality is increased even more. In addition to the developing agents, the developers useful in this invention may also contain sulfites, antifoggants, contrast increasing agents such as the alkanol amines or secondary aliphatic or aromatic alcohols. Development temperatures range between 15° and 50° C. and the pH value between 8 and 12.5 with the range between 8 and 12 being preferred.

The novel mono- and difluorophenyl hydrazine compounds of this invention may be prepared using conventional and well-known synthetic techniques. More specifically the hydrazines of formula I and II can be prepared in accordance with the general procedures set forth in U.S. Pat. Nos. 4,221,857 (Fuji), 4,278,748 (Kodak) 4,030,925 (Kodak), 4,937,160 (Du Pont), 4,686,167 (Anitec). Naturally, these structures must be synthesized to produce compounds that are suitable for addition to silver halide emulsions and silver halide processing fluids. For example, impure compounds or compounds in which unreacted starting materials remain, may produce undesirable, sensitometric results. They may be added to the emulsion in the range of 0.01 to 5.0 g per 1.5 mole of silver halide present (known as a "unit" of emulsion) and preferably at 0.10 to 0.5 per unit of emulsion. When added to the developer system, these compounds may be added in the range of 0.1 to 5 g per liter of developer and preferably at 1 to 3 g per liter.

INDUSTRIAL APPLICABILITY

Silver halide elements made according to the teachings of this invention can be developed at a relatively low pH and short development time (rapid-access) and will yield images with excellent contrast and outstanding dot or image quality. They have low fog and have a lower tendency to produce black spots, e.g., "pepper", in the unexposed or slightly exposed areas. These elements can be effectively used, for example, in the area of reprography, particularly the preparation of screen images from half-tone images by conventional or electronic methods. Also to be mentioned is the reproduction of line images and photomasks for printed circuits or other products for photofabrication, as well as the production of printing manuscripts by phototypesetting techniques.

EXAMPLES

Compounds which exemplify those which can be used within the teachings of this invention and a single compound outside its scope, were made according to the following techniques, with Compound #6 representing the best mode at the time of filing:

Compound 1

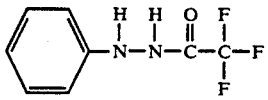

1-Trifluoroacetyl-2-phenylhydrazine (a compound outside the metes and bounds of this invention)

To a solution of phenylhydrazide (10.8 g, 100.0 mmole) and triethylamine (9.0 g, 101.0 mmole) 100 ml of diethyl ether at ice bath temperature was added dropwise trifluoroacetic anhydride (21.0 g, 100.0 mmole). The reaction was stirred for 2 hours and then diluted with 200 ml of pentane and 200 ml of ethyl acetate. The solution was washed with water (200 ml), dried over anhydrous magnesium sulfate and the solvent was removed in vacuo to give an orange solid which was recrystallized from aqueous ethanol to give the title compound as orange brown needles (7.8 g, 41% yield), m.p. 120–121° C.

Compound 2

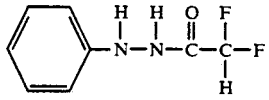

1-Difluoroacetyl-2-phenylhydrazine

A solution of ethyl difluoroacetate (12.0 g, 96.8 mmole) and phenylhydrazine (8.0 g, 74.0 mmole) was stirred in a 100° C. oil bath for 6 hours under nitrogen. A mixture of diethyl ether (60 ml) and pentane (220 ml) was added and the reaction was filtered. The solvent was removed in vacuo to give the title compound as a light yellow crystalline solid (9.3 g, 67% yield), m.p. 82–82° C.

Compound 3

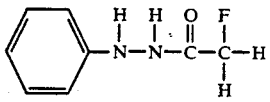

1-Fluoroacetyl-2-phenylhydrazine

A solution of ethyl fluoroacetate (15.0 g, 141.5 mmole) phenylhydrazine (9.3 g, 86.0 mmole) and 4-dimethylaminopyridine (0.05 g, 0.4 mmole) was stirred in a 60° C. oil bath for 72 hours under nitrogen. A mixture of diethyl ether (50 ml) and pentane (100 ml) was added and the reaction was filtered. The solution was concentrated in vacuo to give the title compound as a light yellow crystalline solid (9.5 g, 71% yield), m.p. 90–92° C.

Compound 4

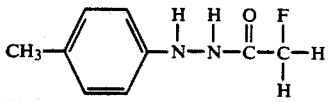

1-Fluoroacetyl-2-(4-methylphenyl)hydrazine

A solution of ethyl fluoroacetate (14.6 g, 138.0 mmole) and p-tolylhydrazine (11.2 g, 70.0 mmole) was stirred in a 60° C. oil bath for 72 hours under nitrogen. The precipitate was collected by filtration to give 3.2 g of crude product. The filtrate was concentrated in vacuo and then stirred with an ether-pentane mixture to precipitate another 5.4 g of crude product. The combined crude material was repeatedly recrystallized from toluene to give a total of 5.8 g (39% yield) of Compound 4 as a light brown solid, m.p. 85–86° C.

Compound 5

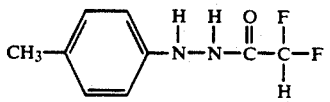

1-Difluoroacetyl-2-(4-methylphenyl)hydrazine

A solution of ethyl difluoroacetate (16.0 g, 129.0 mmole) and p-tolylhydrazine (10.2 g, 63.0 mmole) and 4-dimethylaminopyridine (0.05 g, 0.4 mmole) was stirred in a 60° C. oil bath for 72 hours under nitrogen. The reaction was then filtered and treated in vacuo to remove all volatiles. The residue was heated with an additional 5 g of ethyl difluoroacetate at 180° C. for 20 hours. The reaction was again treated in vacuo to give a dark solid, which was sublimed at high vacuum (0.004–0.01 mmH g) to give Compound 5 as a light yellow solid (6.0 g, 40% yield), m.p. 69–72° C.

Compound 6

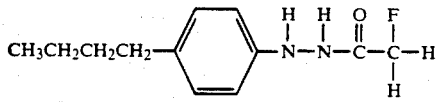

1-Fluoroacetyl-2-(4-n-butylphenyl)hydrazine

Synthesis of 4-n-butylphenylhydrazine

To 300 ml of concentrated hydrochloric acid was added a solution of 4-n-butylaniline (20.0 g, 134.2 mmole) in 200 ml 1 N hydrochloric acid at ice bath temperature. To the resulting slurry was added a solution of sodium nitrite (21.6 g, 313 mmole) in 90 ml of water. The resulting brown solution was stirred at ice bath temperature for 45 minutes and treated dropwise with a solution of tin (II) chloride dihydrate (82.0 g, 363.0 mmole) in 90 ml of concentrated hydrochloric acid. The reaction was stirred for 1 hour at 5° C. and the hydrazine hydrochloride salt was collected by filtration. This was then dissolved in 300 ml of 3N sodium hydroxide solution and the aqueous solution was extracted with diethyl ether (2×200 ml). The combined organic layers were dried over anhydrous magnesium sulfate and the solvent was removed in vacuo to give 18.5 g (84% crude yield) of the titled hydrazine as brown solid which melts around room temperature.

Synthesis of 1-Fluoroacetyl-2-(4-n-butylphenyl)hydrazine

A solution of ethyl fluoroacetate 15.0 g, 141.5 mmole) and 4-n-butylphenylhydrazine (9.3 g. 56.6 mmole) and 4-dimethylaminopyridine (0.05 g, 0.4 mmole) was stirred in a 60° C. oil bath for 20 hours under nitrogen. Pentane (150 ml) was added and the resulting slurry was refrigerated for 1 hour and then filtered to give Compound 6 as a light brown crystalline solid (2.3 g, 19% yield), m.p. 105–106° C.

Compound 7

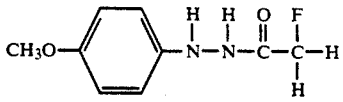

1-Fluoroacetyl-2-(4-methoxyphenyl)hydrazine

A solution of ethyl fluoroacetate (15.8 g, 149.53 mmole) and 4-methoxyphenylhydrazine (6.9 g, 49.8 mmole) was stirred in a 96° C. oil bath for 48 hours under nitrogen. A mixture of diethyl ether (70 ml) and pentane (70 ml) was added, and the resulting slurry was refrigerated for 72 hours. The reaction was filtered to give 2.9 g of crude product which was recrystallized for 30 ml of toluene to give Compound 7 as tan crystals (1.2 g, 12% yield), m.p. 121–123° C.

Compound 8

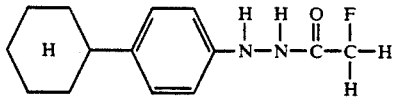

1-Fluoroacetyl-2-(4-cyclohexylphenyl)hydrazine

Preparation of 4-Cyclohexylphenylhydrazine hydrochloride (Intermediate A)

To a slurry a 4-cyclohexylaniline (350.6 g) and ethanol (330 ml) in 30% HCl (1470 ml) was added a solution of sodium nitrite (151.8 g) in water (735 ml), while maintaining the temperature between −8 to −2° C. The reaction was stirred for an additional four hours at −2 to 10° C. A solution of tin (II) chloride dihydrate (1353.8 g) in 30% HCl (1470 ml) was added slowly, and the resulting white suspension was cooled overnight. The crude product was collected by vacuum filtration and washed with 1 N hydrochloric acid, and ether. Recrystallization in 6 L of methanol gave 300 g of the desired product as fine long needles, m.p. 251–254° C.

Preparation of 4-Cyclohexylphenylhydrazine (Intermediate B)

A suspension of 4-cyclohexylphenylhydrazine hydrochloride (Intermediate A) (41.4 g) and 3 N sodium hydroxide (120 ml) was stirred for 10 min at 0–22° C. The mixture was extracted with ether. The solvent was removed under vacuum to give 27 g of the titled compound, m.p. 115–116° C.

Preparation of 1-Fluoroacetyl-2-(4-cyclohexylphenyl)-hydrazine

A mixture of ethyl fluoroacetate (102.0 g, 963.0 mmole), 4-cyclohexylphenylhydrazine (Intermediate B) (35 g, 184.2 mmole) and 4-dimethylaminopyridine (0.2 g, 1.6 mmole) was stirred in a 60° C. oil bath for 6 hours and then at 48° C. for 40 hours under nitrogen. Upon cooling, the product was collected by filtration and washed with diethyl ether to give Compound 8 as white crystalline solid (22 g, 48% yield), m.p. 163.5–164° C.

Compound 9

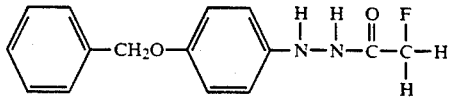

1-Fluoroacetyl-2-(4-benzloxyphenyl)hydrazine

Preparation of 4-Benzyloxyphenylhydrazine Hydrochloride (Intermediate C)

To a slurry of 4-benzyloxyaniline (250 g) and ethanol 300 ml) in 30% HCl (350 ml) and 37% HCl (150 ml) was added a solution of sodium nitrite (77 g) in water (350 ml), while maintaining the temperature between −8 and −2° C. The reaction was stirred for an additional four hours at −2° C. A solution of tin (II) chloride dihydrate (710 g) in 30% HCl (770 ml) was added slowly followed by d-gluconic acid lactone (575 g), and the resulting white suspension was cooled overnight. The crude product was collected by vacuum filtration and washed with 1 N hydrochloric acid, ether, and vacuum dried to give 248.9 g of the desired product, m.p. 173–174° C.

Preparation of 4-Benzyloxyphenylhydrazine (Intermediate D)

A suspension of 4-benzyloxyphenylhydrazine hydrochloride (Intermediate C) (25.0 g) and 1.0 equiv of sodium methoxide in methanol (110 ml) was refluxed for 30 min. The reaction was cooled and the precipitate was collected by vacuum filtration. The crude material was washed with water, and ether and dried under vacuum to give 14.2 g of the desired product, m.p. 101–103° C.

Preparation of 1-Fluoroacetyl-2-(4-benzyloxyphenyl)hydrazine

A mixture of ethyl fluoroacetate (48.0, 452.8 mmole), and 4-benzyloxyphenylhydrazine (Intermediate D) (3.0 g, 14.0 mmole) was stirred at room temperature for 42 hours under nitrogen. The product was collected by filtration and washed with diethyl ether to give Compound 9 as light brown crystalline solid (0 7 g, 18% yield), m.p 116–117° C.

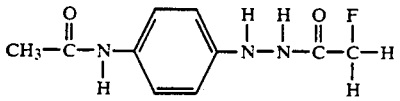

Compound 10

1-Fluoroacetyl-2-(4-acetamidophenyl)hydrazine

Preparation of 1-Fluoroacetyl-2-(4-nitrophenyl)hydrazine (Intermediate E)

A mixture of ethyl fluoroacetate (25.0 g, 235.8 mmole), 4-nitrophenylhydrazine (8.7 g, 56.0 mmole) and 4-dimethylaminopyridine (0.5 g, 4.0 mmole) was stirred in a 120° C oil bath for 20 hours under nitrogen. The product was collected by filtration and washed with diethyl ether to give the titled compound as light brown solid (5.4% yield), m.p. 142–145° C.

Preparation of 1-Fluoroacetyl-2-(4-aminophenyl)hydrazine (Intermediate F)

A solution of 1-fluoroacetyl-2-(4-nitrophenyl)hydrazine (Intermediate E) (13.0 g, 61.0 mmole) in 300 ml of absolute ethanol was hydrogenated at room temperature with 45–50 p.s.i. hydrogen pressure over 10% palladium on charcoal (1.0 g). The reaction was treated with active charcoal and concentrated in vacuo to approximately 100 ml. After refrigeration for 2 days, the titled compound precipitated as light brown solid (6.8 g, 56% yield), m.p. 105–108° C.

Preparation of 1-Fluoroacetyl-2-(4-acetamidophenyl)hydrazine

To a solution of 1-fluoroacetyl-2-(4-aminophenyl)hydrazine (Intermediate F) (3.5 g, 19.0 mmole) and triethylamine (2.3 g, 23.0 mmole) in 70 ml of tetrahydrofuran was added dropwise acetic anhydride (2.1 g, 21.0 mmole). After the initial exothermic reaction had subsided, the resulting slurry was stirred at room temperature for 6 hours. The reaction was filtered and treated in vacuo to give a crude oil, which was stirred with a mixture of 300 ml of diethyl ether and 20 ml of tetrahydrofuran. The solid thus formed was collected by filtration to give Compound 10 as a brown powder (1.9 g, 44% yield), m.p. 142–145° C.

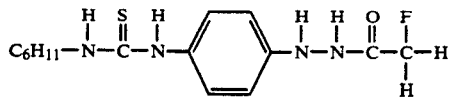

Compound 11

1-Fluoroacetyl-2-(4-cyclohexylthiourediophenyl)hydrazine

A solution of 1-fluoroacetyl-2-(4-aminophenyl)hydrazine (Intermediate F) (3.3 g, 17.8 mmole), cyclohexylisothiocyanate (2.8 g, 19.5 mmole) and 4-dimethylaminopyridine (0.5 g, 4.0 mmole) in 20 ml of acetonitrile was heated in a 95° C. oil bath for 5 hours. The reaction was diluted with 100 ml of diethyl ether and filtered. The filtrate was treated in vacuo to give 4.1 g of crude brown solid, which was recrystallized from a mixture of ethanol and toluene to give the titled compound as a light brown solid (2.9 g, 50% yield), m.p. 148.5–150° C.

EXAMPLE 1

In this Example, a gelatino silver bromoiodide emulsion was prepared and brought to its optimum sensitivity with gold and sulfur salts as is well-known to those skilled in the art. The emulsion was split into 4 portions. Samples of the various compounds made as described above were dissolved in ethanol (1 gm of compound/125 ml of ethanol) and added to the portions of emulsion prior to coating the emulsion on a conventionally subbed, dimensionally stable polyethylene terephthalate film support. 40 ml of each solution was added per 1.5 moles of silver halide present in each portion. Each coating was then overcoated with a thin layer of hardened gelatin and dried. After drying, samples from each coating were given a standard exposure through a standard $\sqrt{2}$ half-tone step wedge and then developed in a standard, commercially available rapid-access, high contrast developer containing hydroquinone and phenidone as developing agents. Each sample was processed for 41 seconds at 39° C. at a pH of 11.1 and then dried. Analysis of these samples gave the following results:

| Compound Added | Dot Quality |
|---|---|
| 1 | Poor |
| 2 | Fair |
| 3 | Good |
| 6 | Excellent |

These results show that only the compounds of this invention are capable of producing high contrast images in rapid access development.

EXAMPLE 2

In this example, tests of compounds made according to the teachings of this invention were tested in a conventional rapid-access, high contrast developer for their effect on a film containing a standard gelatino, silver halide emulsion designed for lithographic systems. Normally, this emulsion would produce good dots only in a slow, litho developer containing only hydroquinone as the developing agent. Each of the compounds listed was added to the developer formulation dissolved in ethanol, e.g., 1 gm/120 ml ethanol, and added to the developer so that the fluoroacetylphenyl hydrazine of this invention was present at a level of 100 mg per liter of developer. For the purposes of this test, strips of standard litho films were given a conventional exposure to a $\sqrt{2}$ half-tone step wedge and then tray-developed for 6 minutes at a pH of 11.2 in the developer containing the compound of this invention. standard processing would require up to 9 minutes. The following results were obtained:

| Compound Added | Infectious Development | Dot Quality |
|---|---|---|
| 8 | Yes | Good |
| 9 | Yes | Good |

By infectious development I mean that non-exposed, adjacent grains will develop in addition to exposed grains. This well-known effect indicates that the requisite high image gradient will be produced. As can be seen by these results, the compounds of this invention can thus be used to produce good, rapid-access, high contrast images in lithographic elements.

I claim:

1. A silver halide element capable of producing images with ultra-high contrast comprising at least one gelatin silver halide layer and containing within the element or on a surface portion a fluorophenyl hydrazine of the following structure:

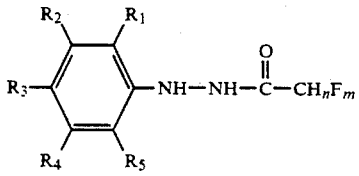

wherein $R_1$ to $R_5$ independently of the other are hydrogen, halogen, alkyl, alkoxy, hydroxyalkyl, halogenated alkyl, alkyl amino, aliphatic acylamino, with, in each case, 1 to 20 carbon atoms, cycloalkyl with 5 to 7 carbon atoms, aryl, aryloxy, or aromatic acylamino with, in each case, 6 to 10 carbon atoms, aralkyl or aralkoxy with 1 to 3 carbon atoms in the alkylene chain, an aliphatic acyl amino radical with 1 to 4 carbon atoms and substituted with a phenoxy radical or a phenoxy radical substituted with one or more alkyl radicals with 1 to 10 carbon atoms, a five-member or six-member heterocyclic ring with at least one of nitrogen and sulfur as heteroatoms, which ring can also be condensed on a benzene ring, or an alkyl or phenyl sulfonamido radical, whereby, in place of two substituents, a saturated or unsaturated ring can also be condensed onto the hydrazine, n and m are 1 or 2, and where n+m=3.

2. The element of claim 1 wherein the hydrazine is of the structure:

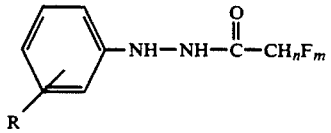

wherein R is H, a phenyl group or a substituted phenyl group, an alkyl, alkoxy or a cycloalkoxy with up to 6 carbon atoms or halogen, n and m are 1 or 2, and where n+m=3.

3. The element of claim 1 wherein said hydrazine is in an emulsion of said element.

4. The element of claim 2 wherein said hydrazine is present in said emulsion in the range of 0.1 to 5.0 gm/1.5 mol of silver halide present.

5. The element of claim 2 wherein said fluorophenyl hydrazine is taken from the group consisting 1-difluoroacetyl-2-phenylhydrazine, 1-fluoroacetyl-2-phenylhydrazine, 1-fluoroacetyl-2-(4-methylphenyl)hydrazine, 1-difluoroacetyl-2-(4-methylphenyl)hydrazine, 1-fluoroacetyl-2-(4-n-butylphenyl)hydrazine, 1-fluoroacetyl-2-(4-cyclohexylphenyl)hydrazine, 1-fluoroacetyl-2-(4-cyclohexylphenyl)hydrazine, 1-fluoroacetyl-2-(4-benxyloxyphenyl)hydrazine, 1-fluoroacetyl-2-(4-acetamidophenyl)hydrazine and 1-fluoroacetyl-2-(4-cyclohexylthiourediohenyl)hydrazine.

* * * * *